US009752588B2

(12) United States Patent
Greer

(10) Patent No.: US 9,752,588 B2
(45) Date of Patent: Sep. 5, 2017

(54) MOLTEN METAL IMPELLER AND SHAFT

(71) Applicant: Karl E. Greer, Lewisport, KY (US)

(72) Inventor: Karl E. Greer, Lewisport, KY (US)

( * ) Notice: Subject to any disclaimer, the term of this patent is extended or adjusted under 35 U.S.C. 154(b) by 0 days.

(21) Appl. No.: 15/394,042

(22) Filed: Dec. 29, 2016

(65) Prior Publication Data

US 2017/0191488 A1 Jul. 6, 2017

Related U.S. Application Data

(60) Provisional application No. 62/273,069, filed on Dec. 30, 2015.

(51) Int. Cl.

| | |
|---|---|
| ***F04D 29/22*** | (2006.01) |
| ***F04D 29/24*** | (2006.01) |
| ***F04D 7/06*** | (2006.01) |
| ***F04D 29/42*** | (2006.01) |

(52) U.S. Cl.

CPC ..... *F04D 29/2277* (2013.01); *F04D 7/065* (2013.01); *F04D 29/2294* (2013.01); *F04D 29/24* (2013.01); *F04D 29/426* (2013.01)

(58) Field of Classification Search

CPC .... F04D 29/2277; F04D 29/22; F04D 29/242; F04D 7/065; F04D 7/06

See application file for complete search history.

(56) References Cited

U.S. PATENT DOCUMENTS 6,439,860 B1 * 8/2002 Greer ..... F04D 7/065 415/200

* cited by examiner

*Primary Examiner* — Gregory Anderson
*Assistant Examiner* — Juan G Flores
(74) *Attorney, Agent, or Firm* — Gary K Price

(57) ABSTRACT

An assembly that includes an impeller having an upper face, a lower face, and a central bore sized and shaped to mate with a connecting end of a shaft. The central bore is defined by a plurality of ledges that each include a cement groove, and channels disposed between the ledges. The connecting end includes a plurality of slots, and extended grooves disposed between the slots. Each extended groove includes an end that extends perpendicular to the length of the extended groove. In application, the plurality of ledges frictionally communicate with the outer surface of the shaft. The plurality of channels of the impeller align with the plurality of grooves of the shaft defining passages that provide a tunnel for entrainment of particles entering the impeller. The cement grooves of the impeller further align with and receive the extended grooves and ends of the shaft resulting in a stronger connection between the shaft and impeller.

20 Claims, 6 Drawing Sheets

MOLTEN METAL IMPELLER AND SHAFT

CROSS REFERENCES TO RELATED APPLICATIONS

U.S. Provisional Application for Patent No. 62/273,069, filed Dec. 30, 2015, with title "Molten Metal Impeller and Shaft" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The invention relates to pumping molten metal and more particularly to an impeller and shaft suited for use in a molten metal pump.

2. Brief Description of Prior Art

A molten metal pump apparatus generally includes a motor mounted above a molten metal bath. The motor drives a rotatable impeller pump having one or more impellers submerged in the bath. In operation, the rotating impellers draw molten material from the bath and pump it through a conduit routed to a subsequent station for further processing.

The molten metal pump typically includes a base having inlet and outlet passages for intake and discharge of the molten metal being pumped. The pump base together with the impeller are submerged in the molten metal by means of posts. The impeller is supported for rotation by means of a rotatable shaft connected to the drive motor located atop a platform which is also supported by the posts.

The portions of the pump assembly submerged in the molten metal are directly contacted and exposed to the harsh conditions thereof, and are formed of refractory material such as graphite, silicone carbide, alumina, zirconia or hexalloy. The posts extend through a level of the molten metal and are connected to a motor mounting plate of the drive arrangement positioned above the level molten metal.

In addition to the hostile environment at the interface between the molten metal and atmosphere, even the molten metal bath itself is not homogeneous. That is, certain suspended solids can be present including unmelted chunks of scrap metal, chunks of alloying metals, and contaminants such as refractory brick spalled from the wall of the furnace, chunks of cement, insoluble metal oxide accretions and the like.

In attempts to eliminate or minimize such problems in the past, immersed impellers of the pumps are either a cup shaped centrifugal impeller having plural radial or angularly directed radial passages with a hollow center portion receiving the molten metal from the inlet and, by centrifugal action, directing the molten metal out the angular radial passages or, a vaned impeller having a generally disc shaped web with flat surface or curved outwardly radially extending vanes.

The impeller is also provided with a base section which serves as the connecting section with the drive shaft and the number of vanes extend approximately radially from the base section. In the prior art, the vanes are not connected to the shaft, and is known as the open-type vanes. In the prior art, the impeller generally includes a central hub for appropriately attaching the shaft thereto and further includes the radially directed vanes as previously described. Generally, the connection between the shaft and impeller has been by male threading on the shaft engaging female threading in the central hub of the impeller with a distinct shoulder at the junction. Potential problems upon attempted replacement of the shaft or the impeller are encountered similar to the replacement problems with respect to the support posts. That is, careful, difficult, labor-intensive manual hammer and chisel work is required to remove all of the old pieces.

Accordingly, an impeller having low clogging characteristics, yet also providing high efficiencies would be highly desirable in the art. The current invention achieves these objectives. Moreover, the current invention achieves a number of advantages in directional forced metal flow. For example, the impeller of the current pump is not prone to clogging as in many of the prior impellers. Accordingly, catastrophic failure is much less likely to occur and the effectiveness of operation does not degrade rapidly over time. The design also achieves high strength between the impeller and shaft and further increases the load area via a contiguous top surface. Furthermore, the impeller and shaft design can be prepared with relatively simple manufacturing processes. Therefore, the cost of production is low and accommodates a wide selection of materials, such as graphite or ceramics.

As will be seen from the subsequent description, the preferred embodiments of the present invention overcome shortcomings of the prior art.

SUMMARY OF THE INVENTION

A molten metal impeller and shaft made in accordance with the present invention. The assembly of the present invention includes an impeller that includes an upper face, a lower face, and a central bore that is sized and shaped to mate with an end of a shaft. The central bore passes through the height of the impeller. The central bore is further defined by a plurality of vanes, and channels disposed between the vanes.

A connecting end of the drive shaft is constructed to be received through the central bore of the impeller and align with the vanes and the channels of the bore. The connecting end includes a distal end sized to pass through a circular ledge adjacent the impeller's lower face, a plurality of slots, and extended grooves disposed between the slots. A cavity is disposed at a lower end of each extended groove, the cavity extends perpendicular to the length of the extended groove.

The connecting end of shaft is received through the central bore of the impeller. When attached, the plurality of vanes of the impeller frictionally communicate with the outer surface of the shaft. Further, the plurality of channels of the impeller align with the plurality of grooves of the shaft defining passages that provide a tunnel at the upper face of the impeller which effectively provides entrainment of any particular particles entering the impeller and prevent lodging/jamming between the rotating impeller body and the pump casing. The cement grooves of the impeller further align with the extended grooves forming a chamber therebetween for injecting cement resulting in a stronger connection between the shaft and impeller.

DESCRIPTION OF THE PREFERRED EMBODIMENT

Figure 1:
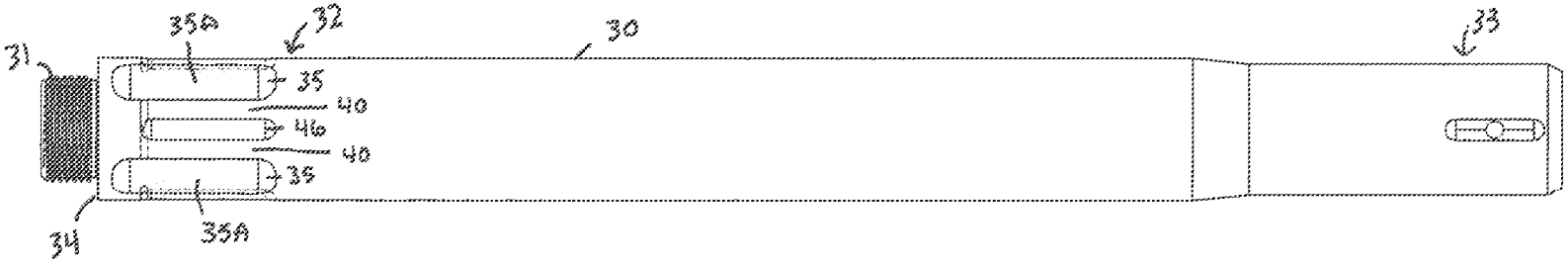
FIG. 1 is a side view of a shaft of the present invention.
Figure 2:
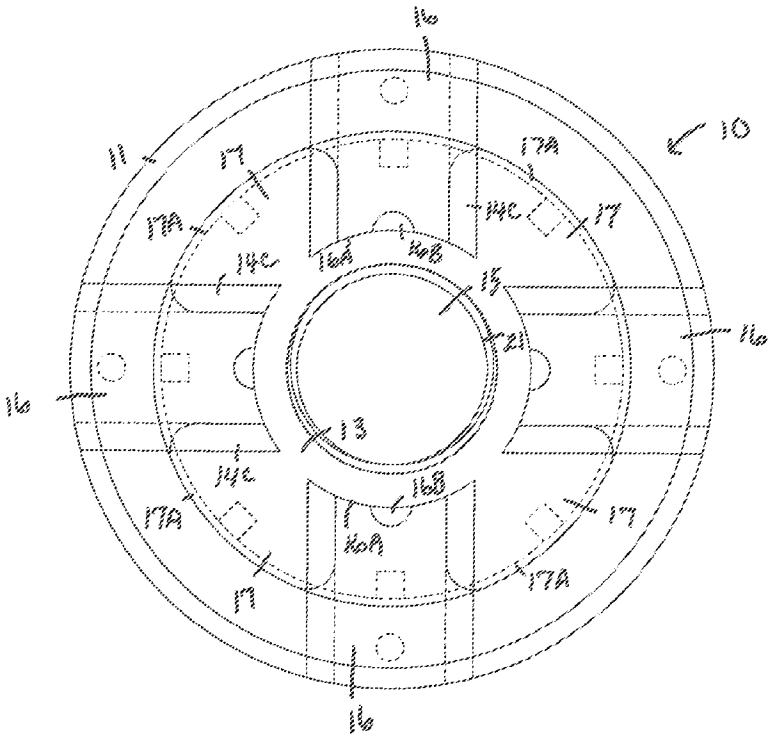
FIG. 2 is a top view of the impeller of the present invention.

In accordance with the present invention, an impeller and shaft for use in a molten metal pump is disclosed. The impeller and shaft of the present invention is directed to an assembly that achieves high strength between the impeller and shaft connection thereby reducing the potential problem of the shaft cracking or breaking during use resulting in replacement of the shaft. In the broadest context, the impeller and shaft assembly for molten metal pump consists of components configured and correlated with respect to each other so as to attain the desired objective.

FIGS. 1-5 illustrate the preferred embodiment of a molten metal impeller and shaft made in accordance with the present invention. The assembly of the present invention includes an impeller vane 10 that is a generally cylindrical shaped body 11 of graphite or ceramic construction and includes an upper face 12, a lower face 13, and a central bore 15 that is sized and shaped to receive and mate with a connecting end of a shaft. The central bore 15 is defined by a plurality of vanes 16 that include ends 16A that extend in perpendicular relationship with the central bore 15. As illustrated, channels 17 are disposed between the vanes 16 that extend downwardly from the upper face 12. The channels 17 are in further communications with openings 20A in the body's 11 sidewall 20.

Figure 4:
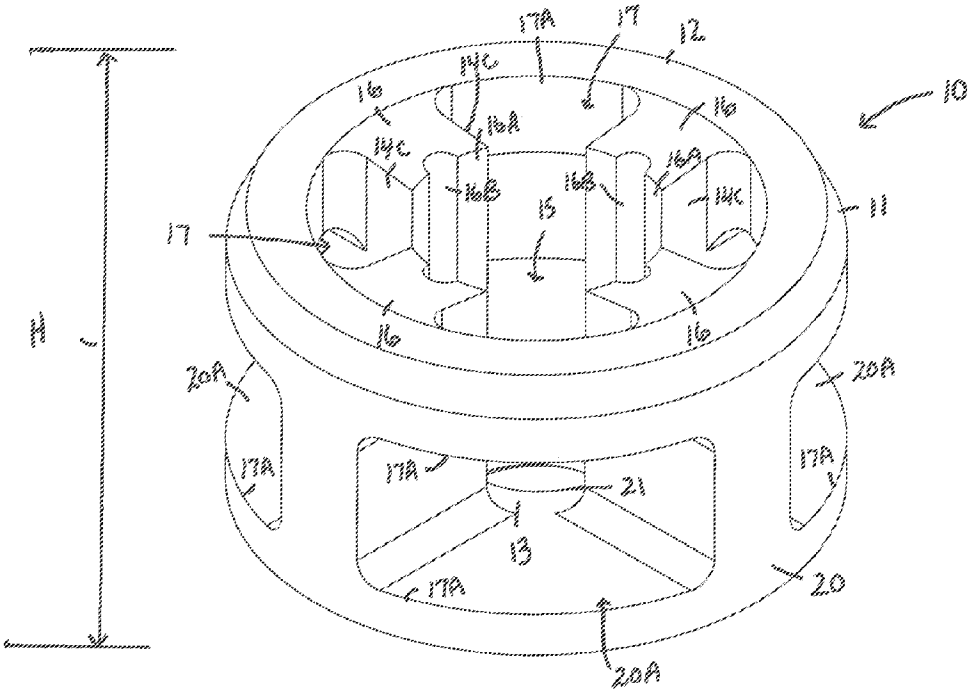
FIG. 4 is a perspective view of the impeller shown in FIG. 2.
Figure 5:
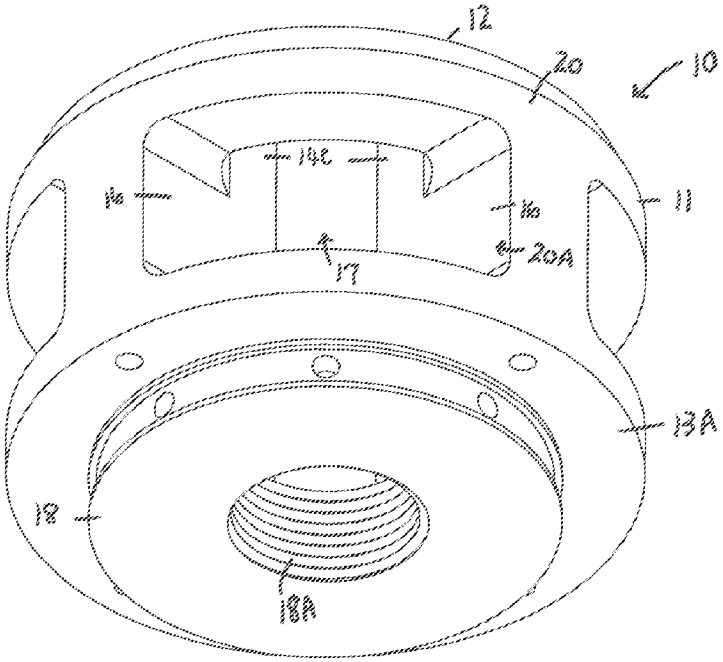
FIG. 5 is a bottom view of the impeller shown in FIGS. 2 and 4.

Each vane 16 further defines at least one planar surface 14C (see FIG. 4) disposed between the vane 16 and channel 17 which can be described as a stability point that adds to the stability between the impeller 10 and the shaft 30. Each channel 17 further defines an inside wall 17A, that as best shown in FIG. 4, joins with upper face 12 and with the lower face 13 having the sidewall opening 20 therebetween.

Each vane 16 further defines a vane end 16A that includes a cement groove 16B centrally disposed on the end 16A. As will be described, each vane 16 and the length of the cement groove 16B vertically extend from the upper face 12 to approximately a circular ledge 21 disposed adjacent the lower face 13.

As will be understood, the outside circumference of a connecting end 32 of a shaft 30 is approximately equal to the inside circumference of the central bore 15 at the point where the vane ends 16A are disposed. It is found that the minimum number of vanes 16 disposed in the bore 15 of the impeller 10 is at least two (2).

Unlike prior art impellers, the central bore 15 of the present invention passes through the height "H" of the impeller 10, from the upper face 12 to the lower face 13. The plurality of vanes 16 and channels 17 similarly extend from the upper face 12 downwardly through the central bore 15 and terminate at the circular ledge 21.

The impeller 10 further includes a threaded member 18 that is adjacent an outer surface 13A of the lower face 13. The threaded member 18 includes an internally threaded portion 18A that as will be described, receives a threaded end 31 of the shaft 30. The threaded portion 18A in communication with the central bore 15.

The drive shaft 30 of the present invention includes an upper end 33 that is configured for connecting to the pump's drive motor (not shown) by means known in the art, and a connecting end 32 opposite the upper end 33.

Figure 3:
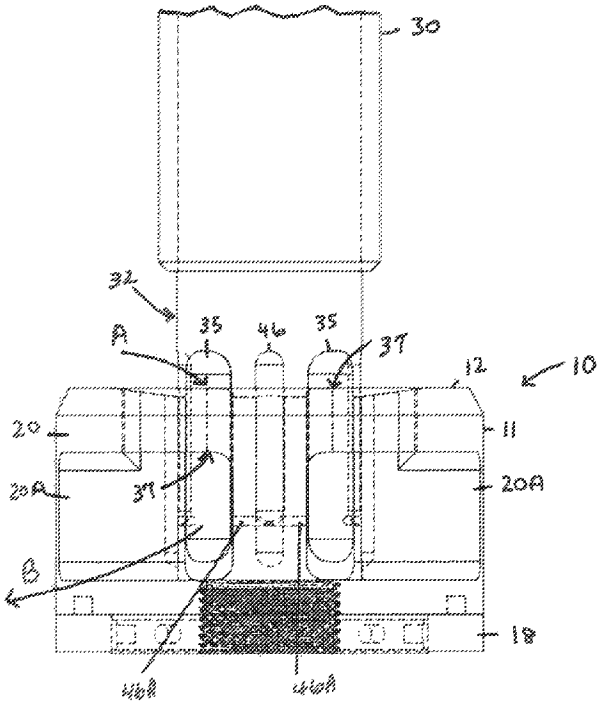
FIG. 3 is an exploded view showing the impeller attached to the shaft and further illustrates material flow.

As shown in FIG. 3, connecting end 32 is constructed to be received through the central bore 15 of the impeller 10 and as will be described, to align with the plurality of vanes 16 and channels 17 within the bore 15. More particularly, connecting end 32 of shaft 30 includes a distal end 34 sized to pass through the circular ledge 21, and a plurality of slots 35 that downwardly extend the approximate length of end 32 of shaft 30 and terminate at distal end 34. Extended grooves 46 are further disposed between the slots 35 and include a horizontal cavity 46A that is disposed perpendicular to the length of the grooves 46.

As illustrated, the connecting end 32 further defines a surface 40 disposed between the slots 35, and as shown, the length of the groove 46 and cavity 46A are disposed on the surface 40.

The shaft 30 includes the threaded end 31 that is adjacent the distal end 34. The threaded portion 18A sized for threaded receipt of the threaded end 31. In application, the connecting end 32 of shaft 30 is received through the central bore 15 of the impeller 10, and the threaded end 31 is threadably received in the threaded portion 18A. When attached, flat surfaces 14C of the impeller frictionally communicate with the outer surface of the shaft. The Inventor has found that the communication between the flat or planar surface areas 14C on the impeller with the shaft as described adds to the stability and performance of the vane so that the impeller vane can push harder during application.

The slots 35 have a concave surface 35A that curves or is hollowed inward. The plurality of channels 17 of the impeller 10 align with the plurality of slots 35 of the shaft defining passages 37 (disposed between the inside wall 17A and slots 35) that are in fluid communications with the sidewall openings 20A that provide a tunnel at the upper face 12 of the impeller 10 which effectively provides entrainment of any particular particles entering the impeller and prevent lodging/jamming between the rotating impeller body and the pump casing.

Moreover, the channels 17 of the impeller 10 are aligned with the slots 35 of the shaft 30 as described resulting in larger diameter vanes or passages 37 that again, effectively prevents lodging/jamming of the rotating impeller body thereby preventing catastrophic failure of the pump. In this regard, FIG. 3 illustrates with arrows the flow of material entering the impeller (designated as arrow "A") and exiting the rotating impeller body (designated as arrow "B") by centrifugal force.

Importantly, cement grooves 16B of the impeller 10 align with the grooves 46 of the shaft 30. Such alignment of grooves 16B and 46 form a chamber therebetween for injecting cement during application, making a stronger connection between the shaft and impeller that is less likely to break.

As disclosed, the cavity 46A is in fluid communication with the extended groove 46 and is disposed in a perpendicular relation to the length of groove 46 such that in application, the cavity 46A extends approximately adjacent the sidewall openings 20A (see FIG. 4). In application, during the step of injecting cement into the chamber formed between the grooves 16B and 46 as disclosed, the user can visually verify the chamber has completely filled the chamber without air pockets once the cement is filled to the top of the formed chamber and the user visually sees cement seeping from the cavity 46A through the sidewall openings 20A.

Figure 6:
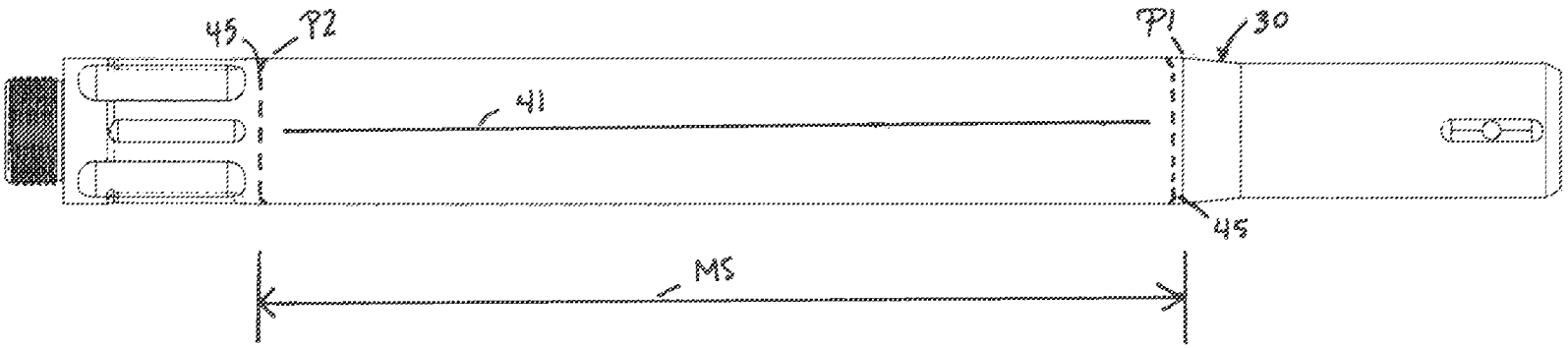
FIG. 6 is a side view of a shaft illustrating the sleeve groove and protective sleeve shown in broken lines.

Referring to FIG. 6, the shaft 30 may further include at least one sleeve groove 41 that vertically extends the approximate length of a mid-section designated as "MS" of the shaft 30, where an upper end of the groove being just below an upper point P1 of the mid-section MS, and the lower end of the sleeve groove being just above point P2 of the mid-section MS. It should be understood that the mid-section MS of the shaft 30 represents an area on the shaft that commonly corrodes and breaks due to use. The shaft 30 includes a protective sleeve 45 or wrap for holding and protecting the mid-section MS of the shaft 30. More particularly, the sleeve 45 is a protective sleeve that is configured for providing protection, e.g., to slow down the corrosion and erosion process that naturally occurs due to extending submersion in the molten metal.

In the preferred embodiment, the protective sleeve 45 is in surrounding relationship to the mid-section MS of the shaft 30 as shown, e.g. substantially from point P1 approximately towards a point P2. The sleeve 45 may extend a slightly greater or lesser distance than the selected distance P1 to P2.

The purpose of the sleeve 45 is to separate the molten metal from the mid-section MS of the shaft 30 during application. By limiting or lessening the extent of communication between the molten metal and the mid-section of the shaft 30, the extent and speed of corrosion is minimized during use.

During manufacture, a fill composition (not shown) for the protective sleeve 45 is poured into a mold between the sides of the mold and the mid-section MS of each shaft 30. The fill composition intersperses around the mid-section MS and forms a wall surrounding the shaft 30. As should be understood, the fill composition further fills the sleeve groove 41 during the pouring process. The term "pour" is used for the introduction of the fill composition into the mold, and is intended to encompass any method of introducing a fill composition into the mold in a liquid or other fluent form. It is important that the fill composition be fluent because otherwise, the fill composition will not intersperse around that area defined as the mid-section MS and the sleeve groove 41.

Thus, it is apparent that there has been provided, in accordance with this invention, a molten metal impeller and shaft that fully satisfies the objects, aims and advantages set forth above.

Although the description above contains many specificities, these should not be construed as limiting the scope of the invention but as merely providing illustrations of some of the presently preferred embodiments of this invention. Thus the scope of the invention should be determined by the appended claims in the formal application and their legal equivalents, rather than by the examples given.

I claim:

1. An impeller and shaft assembly comprising:

a cylindrical impeller having a plurality of channels, and a shaft member having a connecting end that defines a plurality of concave surfaces that align with said channels, wherein said impeller defines a plurality of vanes that define stability points that are in frictional communication with an outer surface of said shaft member, and wherein said vanes further include cement grooves that align with said connecting end of said shaft member.

2. The assembly as recited in claim 1, wherein said impeller further includes a central bore, and wherein said connecting end passes through said central bore.

3. The assembly as recited in claim 2, wherein said connecting end includes a plurality of extended grooves that align with said cement grooves, and wherein a lower end of each of said extended grooves include a cavity.

4. The assembly as recited in claim 3, wherein said cavity is perpendicular to a length of said extended groove.

5. The assembly as recited in claim 4, wherein said plurality of channels are disposed between said plurality of vanes, and wherein each of said stability points is adjacent the vane and the channel.

6. An impeller and shaft assembly comprising:

a cylindrical impeller, and a shaft member having a connecting end, wherein said impeller defines a plurality of channels that align with concave surfaces of said connecting end, and wherein said impeller further defines at least one (1) cement groove that aligns with at least one extended groove of said connecting end, wherein said at least one cement groove aligns with said extended groove forming a chamber therebetween, and wherein at least one planar surface is defined adjacent each of said plurality of channels and are in frictional communication with an outer surface of said connecting end, and wherein passages are defined between said channels and said concave surfaces.

7. The assembly as recited in claim 6, wherein said cylindrical impeller further includes a lower face and a central bore, and wherein said central bore is sized to receive said connecting end.

8. The assembly as recited in claim 7, wherein said central bore includes a plurality of vanes having vane ends, and wherein each of said vane ends include said cement groove.

9. The assembly as recited in claim 8, wherein said central bore further includes a circular ledge adjacent said lower face.

10. The assembly as recited in claim 9, wherein said connecting end sized to frictionally pass through said circular ledge.

11. The assembly as recited in claim 10, wherein said passages are defined between an inside wall of each of said channels and said concave surfaces.

12. The assembly as recited in claim 11, wherein a lower end of said extended groove includes a cavity that is perpendicular to a length of said extended groove.

13. The assembly as recited in claim 12, wherein said inside wall joins with the upper face and extends downwardly to the lower face.

14. The assembly as recited in claim 13, wherein each of said plurality of concave surfaces downwardly extend an approximate length of said connecting end.

15. The assembly as recited in claim 14, wherein said impeller vane includes at least two (2) vanes.

16. The assembly as recited in claim 15, wherein a protective sleeve is in surrounding relationship to said mid-section.

17. The assembly as recited in claim 12, wherein said shaft member further defines at least one sleeve groove that vertically extends an approximate length of a defined mid-section of said shaft member.

18. An impeller and shaft assembly comprising:

a cylindrical impeller vane having an upper face, a lower face and a central bore that defines a height that extends from the upper face to the lower face, said central bore includes a plurality of vanes having vane ends that extend in perpendicular relation with said height and channels disposed between the plurality of vanes, and wherein each of said plurality of vanes define at least one planar surface adjacent the vane and the channel, and wherein each of said vane ends include a cement groove, and wherein said central bore further defines a circular ledge adjacent said lower face;

a shaft member having a connecting end sized to frictionally pass through said circular ledge, a plurality of concave surfaces and extended grooves disposed on a surface between each of said plurality of concave surfaces, and wherein each of said extended grooves include a cavity that is perpendicular to the length of said extended groove;

and wherein said channels align with said concave surfaces such that passages are defined between an inside wall of each of said channels and said concave surfaces;

and wherein said cement grooves align with said extended grooves forming a chamber therebetween.

19. The assembly as recited in claim 18, wherein said cement groove is centrally disposed on said vane end.

20. The assembly as recited in claim 19, wherein each of said channels extend the height of said central bore.

* * * * *